US011459518B2

(12) United States Patent
Gadsbøl et al.

(10) Patent No.: US 11,459,518 B2
(45) Date of Patent: Oct. 4, 2022

(54) GASIFICATION UNIT, A METHOD FOR PRODUCING A PRODUCT GAS AND USE OF SUCH A METHOD

(71) Applicant: Danmarks Tekniske Universitet, Kgs. Lyngby (DK)

(72) Inventors: Rasmus Østergaard Gadsbøl, Allerød (DK); Ulrik Birk Henriksen, Soborg (DK); Jesper Ahrenfeldt, Frederiksvaerk (DK)

(73) Assignee: Danmarks Tekniske Universitet, Kgs. Lyngby (DK)

( * ) Notice: Subject to any disclaimer, the term of this patent is extended or adjusted under 35 U.S.C. 154(b) by 0 days.

(21) Appl. No.: 16/652,621

(22) PCT Filed: Oct. 12, 2018

(86) PCT No.: PCT/DK2018/050256
§ 371 (c)(1),
(2) Date: Mar. 31, 2020

(87) PCT Pub. No.: WO2019/072350
PCT Pub. Date: Apr. 18, 2019

(65) Prior Publication Data

US 2020/0239792 A1 Jul. 30, 2020

(30) Foreign Application Priority Data

Oct. 12, 2017 (DK) ..... PA 2017 70775

(51) Int. Cl.
*C10J 3/36* (2006.01)
*C10J 3/66* (2006.01)

(52) U.S. Cl.
CPC . *C10J 3/36* (2013.01); *C10J 3/66* (2013.01); *C10J 2200/158* (2013.01); *C10J 2300/0916* (2013.01); *C10J 2300/1807* (2013.01); *C10J 2300/1884* (2013.01)

(58) Field of Classification Search
CPC . C10J 3/36; C10J 3/66; C10J 2200/158; C10J 2300/0916; C10J 2300/1807; C10J 2300/1884
See application file for complete search history.

(56) References Cited

U.S. PATENT DOCUMENTS 3,853,498 A * 12/1974 Bailie ..... F23G 5/027 48/209
4,069,024 A 1/1978 Fernandes
(Continued)

FOREIGN PATENT DOCUMENTS

CN 101818081 A 9/2010
CN 101978031 A 2/2011
(Continued)

OTHER PUBLICATIONS

International Search Report and Written Opinion for PCT/DK2018/094878, dated Jan. 2, 2019, 9 pages.

*Primary Examiner* — Matthew J Merkling
(74) *Attorney, Agent, or Firm* — Blank Rome LLP

(57) ABSTRACT

Disclosed is a gasification unit (1) for producing a product gas. The gasification unit (1) comprises a co-current or counterflow pyrolysis unit (2) including a pyrolysis gas outlet (3) arranged at an upper part (4) of the pyrolysis unit (2) and a pyrolysis gas inlet (5) arranged at a lower part (6) of the pyrolysis unit (2). The gasification unit (1) further comprises a co-current or counterflow gasifier (7) including a product gas outlet (8) arranged at an upper part (9) of the gasifier (7) and a gasifier inlet (10) arranged at a lower part of the gasifier (7) and coke moving means (12) for allowing pyrolyzed coke (13) to move from the pyrolysis unit (2) to the gasifier (7). The gasification unit (1) also comprises recycling means (14) arranged to guide at least a part of the pyrolysis gas produced in the pyrolysis unit (2) from the pyrolysis gas outlet (3) and back to the pyrolysis gas inlet (5)
(Continued)

Figure 1:
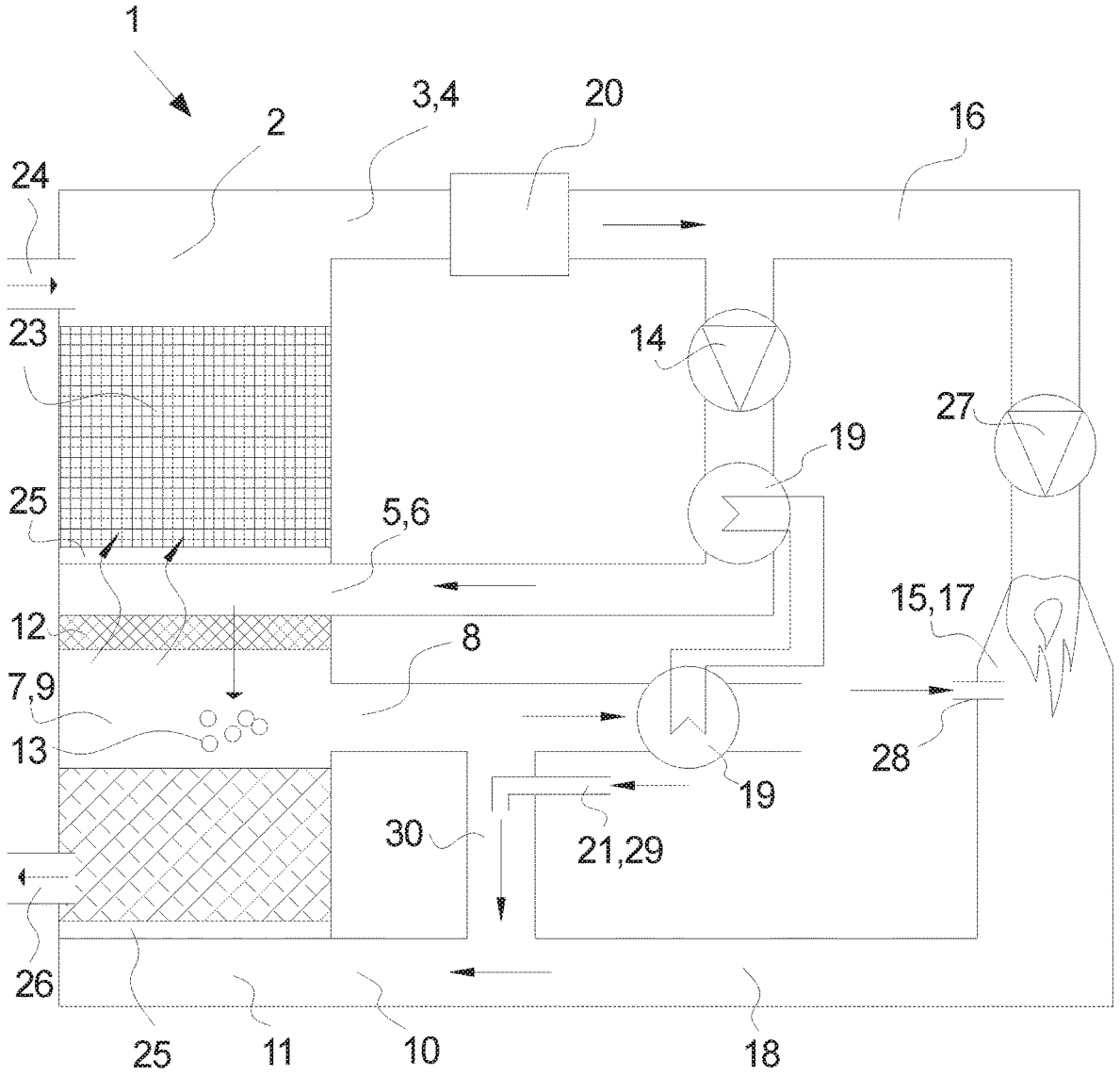

and heating device (15) comprising an input conduit (16) arranged to guide pyrolysis gas from the pyrolysis gas outlet (3) to a combustion unit (17) in the heating device (15), wherein the combustion unit (17) is arranged to least a partially oxidize the pyrolysis gas from the pyrolysis unit (2), and wherein the heating device (15) comprises an output conduit (18) arranged to guide heating gas generated by the partial oxidization in the combustion unit (17) to the gasifier inlet (10), where in the heating device (15) is arranged external to the pyrolysis unit (2) and the gasifier (7) and wherein said gasification unit (1) further comprises heat exchange means (19) arranged for heating at least a portion of the pyrolysis gas before it enters the pyrolysis unit (2) through said pyrolysis gas inlet (5) by means of at least a part of the product gas exiting said gasifier (7) through said product gas outlet (8). Furthermore, a method for producing a product gas in a gasification unit (1) and use of such a method is disclosed.

13 Claims, 2 Drawing Sheets

(56) References Cited

U.S. PATENT DOCUMENTS

| | | | | | |
|---|---|---|---|---|---|
| 4,407,699 | A * | 10/1983 | Flockenhaus | C10B 27/00 | 201/39 |
| 5,069,765 | A * | 12/1991 | Lewis | C10J 3/723 | 204/173 |
| 8,790,428 | B2 | 7/2014 | Tetzlaff | | |
| 2009/0020052 | A1 * | 1/2009 | Becchetti | F23G 5/46 | 110/346 |
| 2010/0011664 | A1 * | 1/2010 | Ariyapadi | C10K 1/02 | 48/128 |
| 2011/0061298 | A1 * | 3/2011 | Frey | F23K 1/04 | 48/78 |
| 2011/0083367 | A1 * | 4/2011 | Tetzlaff | C10J 3/54 | 48/111 |
| 2012/0256131 | A1 * | 10/2012 | Ko | C10J 3/72 | 252/373 |
| 2013/0000569 | A1 | 1/2013 | Schneider et al. | | |
| 2013/0026419 | A1 * | 1/2013 | Song | C10J 3/62 | 252/373 |
| 2013/0185999 | A1 * | 7/2013 | Chen | F23G 5/027 | 48/111 |
| 2016/0017801 | A1 * | 1/2016 | Xue | C10J 3/62 | 60/39.12 |

FOREIGN PATENT DOCUMENTS

| | | | |
|---|---|---|---|
| CN | 103045307 | A | 4/2013 |
| CN | 103305285 | A | 9/2013 |
| JP | 2013/181113 | A | 9/2013 |
| WO | WO-01/68789 | A1 | 9/2001 |
| WO | WO-2008/107727 | A2 | 9/2008 |
| WO | WO-2009/151369 | A1 | 12/2009 |
| WO | WO-2010/109501 | A1 | 9/2010 |
| WO | WO-2016/203232 | A1 | 12/2016 |

* cited by examiner

GASIFICATION UNIT, A METHOD FOR PRODUCING A PRODUCT GAS AND USE OF SUCH A METHOD

RELATED APPLICATIONS

This application is a national phase of PCT/DK2018/050256, filed on Oct. 12, 2018, which claims the benefit of Danish Application No. PA 2017 70775, filed on Oct. 12, 2017. The entire contents of those applications are hereby incorporated by reference.

FIELD OF THE INVENTION

The invention relates to a gasification unit for producing a product gas. The gasification unit comprises a co-current or counterflow pyrolysis unit and a co-current or counterflow gasifier. The invention further relates to a method for producing a product gas in a gasification unit and use of such a method.

BACKGROUND OF THE INVENTION

Producing product gas from biomass, coal or other is well known in the art e.g. by means of two stage gasification typically based on externally heated pyrolysis and a coke bed in downstream configuration. However, externally heated pyrolysis is problematic—particularly in larger scale because of difficulties in supplying sufficient heat- and the downstream configuration is problematic in that it can be sensitive to dust and smaller particles.

Thus, from U.S. Pat. No. 4,069,024 a two-stage gasification system for carbonaceous material is known, wherein the system comprises a pyrolyzing reactor followed by a gasifier and wherein at least some of the produced product gas is guided back into the gasifier and an ignition zone is formed centrally within the gasifier to increase the temperature inside the gasifier. However, this setup requires substantial subsequent gas cleaning.

It is therefore an object of the present invention to provide for a cost-efficient technique for producing a cleaner product gas.

The Invention

The invention provides for a gasification unit for producing a product gas. The gasification unit comprises a co-current or counterflow pyrolysis unit including a pyrolysis gas outlet arranged at an upper part of the pyrolysis unit and a pyrolysis gas inlet arranged at a lower part of the pyrolysis unit. The gasification unit further comprises a co-current or counterflow gasifier including a product gas outlet arranged at an upper part of the gasifier and a gasifier inlet arranged at a lower part of the gasifier and coke moving means for allowing pyrolyzed coke to move from the pyrolysis unit to the gasifier. The gasification unit also comprises recycling means arranged to guide at least a part of the pyrolysis gas produced in the pyrolysis unit from the pyrolysis gas outlet and back to the pyrolysis gas inlet and heating device comprising an input conduit arranged to guide pyrolysis gas from the pyrolysis gas outlet to a combustion unit in the heating device, wherein the combustion unit is arranged to least a partially oxidize the pyrolysis gas from the pyrolysis unit, and wherein the heating device comprises an output conduit arranged to guide heating gas generated by the partial oxidization in the combustion unit to the gasifier inlet, wherein the heating device is arranged external to the pyrolysis unit and the gasifier and wherein the gasification unit further comprises heat exchange means arranged for heating at least a portion of the pyrolysis gas before it enters the pyrolysis unit through the pyrolysis gas inlet by means of at least a part of the product gas exiting the gasifier through the product gas outlet.

Partial oxidization inside the pyrolysis unit or the gasifier is practical because the pyrolysis unit or the gasifier is already cable of handling the high temperatures generated by the combustion. However, arranging the heating device external to the pyrolysis unit and the gasifier is advantageous in that it provides a more controlled environment and thereby a more controlled partial oxidation and thereby better tar decomposition.

And it is advantageous to heat the pyrolysis gas before it enters the pyrolysis unit by means of the product gas exiting the gasifier in that the temperature of the recirculating pyrolysis gas has to be raised and the temperature of the product gas has to be lowered and both these things hereby can be achieved in a simple and inexpensive manner.

In this context, the term "pyrolysis unit" should be understood as any kind of unit capable of running a pyrolysis process, which is a thermochemical decomposition of organic material or fossil fuel at elevated temperatures in the absence of oxygen (or any halogen). However, oxygen may be used to run the pyrolysis process, e.g. in the form of at least partial oxidation inside the pyrolysis unit that will raise the temperature to a level suitable for pyrolysis but the oxygen does not form part of the pyrolysis process itself. Pyrolysis involves the simultaneous change of chemical composition and physical phase, and is irreversible. Pyrolysis is a type of thermolyzes, and is most commonly observed in organic materials exposed to high temperatures typically starting at 200-300° C. and up to 500 C or even higher. In general, pyrolysis of organic substances or fossil fuels produces gas and liquid products and leaves a solid residue richer in carbon content, which in this embodiment is referred to as pyrolysis coke but is also often referred to as pyrolysis char. It should also be noted that in this context the term "pyrolysis" or "pyrolyzed" also covers torrefaction which is a mild form of pyrolysis at temperatures typically between 200 and 320° C. depending on the specific material being pyrolyzed.

Furthermore, it should be emphasised that the term "gasifier" is to be understood as any kind of device suitable for running a gasification process in which organic or based carbonaceous materials is converted into mainly carbon monoxide, hydrogen, carbon dioxide or similar. This is achieved in the gasifier by reacting the material at high temperatures (typically higher than 700° C.). The resulting gas mixture is in this embodiment called product gas but could in other embodiments be referred to as syngas, synthesis gas, producer gas or other and is itself a fuel.

It should also be emphasised that the term "coke moving means" is to be understood as any kind of conveyer, auger, slide, valve, register, gate or similar or any combination thereof or any other kind of coke mover suitable for moving or at least allowing pyrolyzed coke to move from the pyrolysis unit to the gasifier.

Further, it should be emphasised that the term "recycling means" is to be understood as any kind of pipe, pump, fan, conduit or similar or any combination thereof or any other kind of recycler suitable for guiding at least a part of the pyrolysis gas produced in the pyrolysis unit from the pyrolysis gas outlet and back to the pyrolysis gas inlet.

It should also be emphasised that the term "counterflow" (pyrolysis unit or gasifier) is to be understood any kind of pyrolysis unit or gasifier where hot gas, air, steam or another gaseous substance is being fed in the bottom of the pyrolysis unit or gasifier to either directly or indirectly drive the respective pyrolysis or gasification and the resulting gas is drawn from the top of the pyrolysis unit or gasifier, while the fuel is fed at the top of the pyrolysis unit or gasifier so that the closer the fuel moves to the bottom of the pyrolysis unit or gasifier the more processed it is. I.e. fuel and gas moves in opposite directions—hence "counterflow". In this context "counterflow" is also often referred to as "updraft", "upward draft", "counter-current" and other.

Likewise, it should also be emphasised that the term "co-current" (pyrolysis unit or gasifier) is to be understood any kind of pyrolysis unit or gasifier where hot gas, air, steam or another gaseous substance is being fed in the top of the pyrolysis unit or gasifier to either directly or indirectly drive the respective pyrolysis or gasification and the resulting gas is drawn from the bottom of the pyrolysis unit or gasifier, while the fuel is fed at the top of the pyrolysis unit or gasifier so that the closer the fuel moves to the bottom of the pyrolysis unit or gasifier the more processed it is. I.e. fuel and gas moves in the same direction—hence "co-current". In this context "co-current" is also often referred to as "downdraft", "downward draft", "downstream" and other.

It should also be emphasised that the term "heat exchange means" is to be understood as any kind of heat exchanger suitable for exchanging heat between pyrolysis gas before it enters the pyrolysis unit and the product gas exiting the gasifier—such as any kind of shell heat exchanger, plate heat exchanger, tube heat exchanger or other.

In an aspect, the pyrolysis gas outlet is connected to filtering means arranged to separate particles from pyrolysis gas flowing out through the pyrolysis gas outlet.

It is advantageous to filter the pyrolysis gas in that the risk of unwanted particle build-up in the system is hereby reduced.

In this context, the term "filtering means" is to be understood as any kind of filter suitable for separating particles from the pyrolysis gas leaving the pyrolysis unit—i.e. any kind of cyclone, sieve, strainer or another device for cleaning the pyrolysis gas flow.

In an aspect, the gasification unit comprises cooling means for cooling the heating gas to a temperature between 600° C. and 1,200° C., preferably between 700° C. and 1,100° C. and most preferred between 800° C. and 1,000° C. before it enters the gasifier.

If the entrance temperature of the heating gas is too high when it enters the gasifier, the risk of the heat damaging the gasifier and/or equipment in the gasifier is increased. However, if the entrance temperature is too low the gasification process will be inefficient, and the capacity of the gasifier is reduced. Thus, the present temperature ranges present an advantageous relationship between safety and efficiency.

In an aspect, the cooling means comprises means for adding steam to the heating gas and/or adding product gas to the heating gas to cool the heating gas.

Cooling the heating gas by means of steam or product is a fast, inert and efficient way of cooling the heating gas.

In an aspect, the co-current or counterflow pyrolysis unit is arranged on top of the co-current or counterflow gasifier.

Arranging the co-current or counterflow pyrolysis unit above the co-current or counterflow gasifier is advantageous in that gravity hereby will aid in moving the pyrolyzed coke from the pyrolysis unit and down into the gasifier.

In an aspect, the coke moving means comprises a screw conveyor.

A screw conveyer is a safe, inexpensive and efficient way of moving coke from a pyrolysis unit to a gasifier.

The invention further provides for a method for producing a product gas in a gasification unit. The method comprises the steps of:

- feeding fuel to a co-current or counterflow pyrolysis unit,
- circulating at least a part of the pyrolysis gas produced by the fuel in the pyrolysis unit back into the pyrolysis unit to form a flow of pyrolysis gas up through the fuel,
- heating the pyrolysis gas before it re-enters the pyrolysis unit
- pyrolyzing the fuel by means of the re-entering heated pyrolysis gas
- enabling that the pyrolyzed fuel in the pyrolysis unit is moved to a gasifier
- combusting at least a part of the pyrolysis gas outside the pyrolysis unit and the gasifier to form heating gas,
- guiding the heating gas into the gasifier to heat the pyrolyzed fuel to produce a product gas, wherein the pyrolysis gas is heated by means of the product gas before the pyrolysis gas re-enters the pyrolysis unit.

By partially oxidizing the pyrolysis gas outside the gasifier before it enters the gasifier it is—due to the more controlled environment—possible to better reduce the tar content in the entering heating gas and thereby reduce the tar content in the product gas exiting the gasifier. And heating the pyrolysis gas by means of the produced product gas is advantageous in that this heat source is readily available and it in that it at the same time will cool the product gas and thereby save time and energy to perform this operation.

In an aspect, the pyrolysis gas is heated by means of the product gas by guiding the pyrolysis gas and the product gas through the same heat exchanger means.

Guiding the pyrolysis gas and the product gas through the same heat exchanger in which pyrolysis gas is heated by means of the product gas directly (i.e. through a metal plate or pipe in the heat exchanger) is advantageous in that this ensures a simple, efficient, and less complicated heat exchange.

In an aspect, the pyrolysis gas is heated by means of the product gas by guiding the pyrolysis gas through a first heat exchange means and guiding the product gas through second heat exchange means and establish a separate fluid flow between the first and the second heat exchange means to transfer heat between the first and the second heat exchange means.

Making the pyrolysis gas and the product gas exchange heat indirectly through a separate fluid circulating between at least the two abovementioned separate heat exchangers is advantageous in that this enables that the heat may be transported over a larger distance and e.g. exchange heat with further processes or other.

In an aspect, the pyrolysis gas is heated by means of the product gas before the pyrolysis gas re-enters the pyrolysis unit.

The product gas will typically be between 600° C. and 1,000° C. and most often between 700° C. and 800° C. when leaving the gasifier and will therefore have to be cooled. It is therefore advantageous to heat the recycled pyrolysis gas by means of this readily available heat source—particularly since the pyrolysis gas re-entering the pyrolysis unit only has to be heated to around or a little over 500° C.

In an aspect, between 1% and 95%, preferably between 5% and 70% and most preferred between 10% and 50%—such as between 20% to 30%—of the pyrolysis gas produced by the fuel in the pyrolysis unit is circulated back into the pyrolysis unit to form a flow of pyrolysis gas up through the fuel.

If too much or too little of the pyrolysis gas is circulated back into the pyrolysis unit, the gasification unit will run more inefficiently. Thus, the present amount ranges will ensure higher efficiency.

Even further, the invention provides for use of a method according to any of the previously mentioned methods for producing a product gas from biomass in a gasification unit according to any of the previously discussed gasification units.

Pyrolyzing and/or gasification of biomass is problematic in relation to tar content in the resulting gas and it is therefore particularly advantageous to use the present invention in relation to pyrolyzing and/or gasification of biomass.

FIGURES

Figure 2:
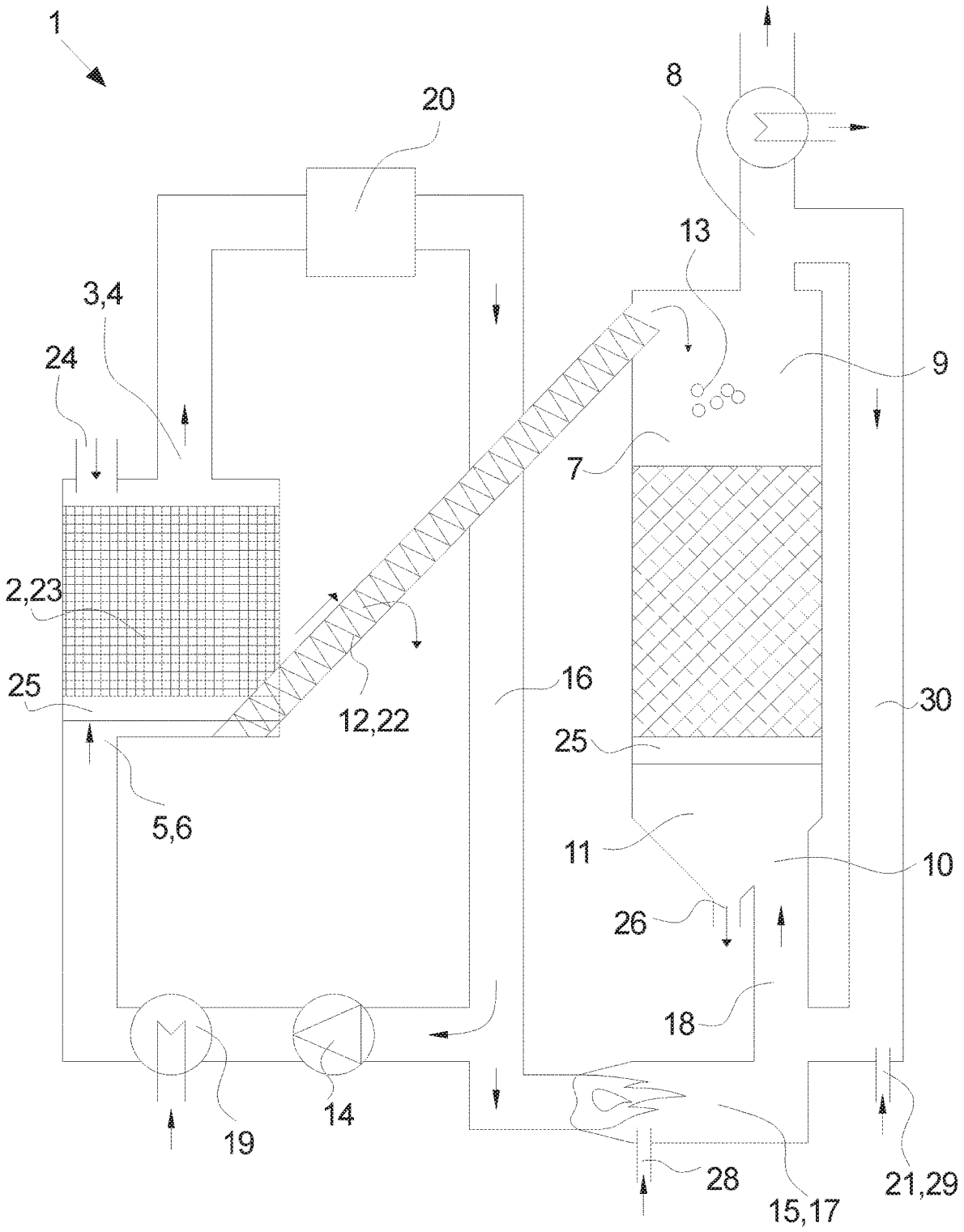

The invention will be described in the following with reference to the figures in which FIG. 1. illustrates a gasification unit with a pyrolysis unit arranged on top of a gasifier, as seen from the front, and FIG. 2 illustrates a gasification unit with a pyrolysis unit arranged beside a gasifier, as seen from the front.

DETAILED DESCRIPTION

FIG. 1 illustrates a gasification unit 1 with a counterflow pyrolysis unit 2 arranged on top of a counterflow gasifier 7, as seen from the front and FIG. 2 illustrates a gasification unit 1 with a counterflow pyrolysis unit 2 arranged beside a counterflow gasifier 7, as seen from the front.

The units 1 illustrated in FIGS. 1 and 2 have many features in common and in principle only the displacement of the pyrolyzed coke 13 from the pyrolysis unit 2 to the gasifier differs and except for this issue both drawings will be discussed simultaneously in the following.

In this embodiment fuel 23 is guided into pyrolysis unit 2 through a fuel inlet 24 at an upper part 4 of the pyrolysis unit 2.

In this embodiment, the fuel 23 is wood chips but in another embodiment the fuel could be (raw or pre-dried) animal slurry, (raw or pre-dried) sewage, surplus material from biochemical production or food production, another natural plant material or any other form of organic material or fossil fuel.

At the top 4 of the pyrolysis unit 2 the operation temperature will typically be around 250-300° C. but as the fuel 23 moves downwards inside the pyrolysis unit 2 the temperature rises to 500° C. or more at the bottom 6 of the pyrolysis unit 2. At the lower part 6 of the pyrolysis unit 2 the fuel is transformed into pyrolyzed coke 13 and it will fall through the grate device 25 on which the fuel 23 rests in the pyrolysis unit 2.

In the embodiment disclosed in FIG. 1 the pyrolyzed coke 13 continues down through the coke moving means 12 arranged to allow the coke 13 to move downwards to the gasifier 7, while at the same time ensuring that gas can only travel upwards—i.e. ensuring that pyrolysis gas cannot travel downwards into the upper part 9 of the gasifier 7. In this embodiment, the coke moving means 12 could comprise a register, a gate, a lock, a sluice or other e.g. comprising some sort of gas lock.

In the embodiment disclosed in FIG. 2 the coke moving means 12 comprises a screw conveyer 22 arranged to move the pyrolyzed coke 13 from the bottom 6 of the pyrolysis unit 2 to the top 9 of the gasifier 7. However, in another embodiment the coke moving means 12 could comprise conveyers, slides, tubes or other or any combination thereof.

In this embodiment, the pressure inside the gasifier 7 is at least slightly higher than the pressure inside the pyrolysis unit 2—or at least slightly higher than the pressure just above the coke moving means 12—that the risk of pyrolysis gas traveling into the gasifier 7 via coke moving means 12 or other is substantially eliminated.

In the upper part 9 of the gasifier 7 the temperature is in this embodiment 700-750° C. but it will rise as the pyrolyzed coke 13 travels down through the gasifier 7 to around 950° C. before the gasified material is removed as ash material or gasifier coke through an ash outlet 26 at the bottom 11 of the gasifier 7.

It should be underlined that the temperature examples mentioned above and below are specific examples relating to a specific type of wood chip being used as fuel 23 in this embodiment. However, if different fuel 23 was used some of the temperatures might be higher or lower.

In the pyrolysis units 2 the produced pyrolysis gas will travel upwards and leave the pyrolysis units 2 through the pyrolysis gas outlet 3. From there the pyrolysis gas travels through filtering means 20 in which dust and minor particles are removed from the gas. After the filtering means 20 the pyrolysis gas is divided into two different flow directions with one guiding the some of the pyrolysis gas back to the pyrolysis units 2 and with the other guiding the remaining pyrolysis gas towards the gasifier 7. Recycling means 14 comprising a fan (or another type of flow generator) arranged to generate a pyrolysis gas flow and pipes arranged to guide the pyrolysis gas will thereby guide a part of the pyrolysis gas produced in the pyrolysis unit 2 from the pyrolysis gas outlet 3 and back to the pyrolysis gas inlet 5. However, before the recycled pyrolysis gas enters the pyrolysis units 2 the pyrolysis gas is heated so that when it enters the pyrolysis gas it has a temperature of around—or preferably above −500° C.

In this embodiment, the recycled pyrolysis gas is heated by means of a heat exchanger 19 enabling that the pyrolysis gas is being heated by the product gas leaving the gasifier 7. In FIG. 1 a heat exchanger 19 is arranged in relation to both the pyrolysis gas and the product gas and these two heat exchangers are then arranged to exchange heat through a separate fluid flowing in pipes connecting the first heat exchanger 19 with the second heat exchanger 19. However, in a preferred embodiment the two illustrated heat exchangers 19 are in fact the one and the same heat exchanger 19 and in such an embodiment the product gas leaving the gasifier 7 will exchange heat directly with the pyrolysis gas in the same heat exchanger means 19. Or in another embodiment the gasification unit 1 could comprise means enabling that the recycled pyrolysis gas could be heated by means of another internal heat source—such as e.g. partial oxidation—or by means of an external heat source and likewise the product gas could be cooled by means of another internal source or an external source.

In this embodiment the heat exchanger means 19 are plate heat exchangers but in another embodiment one or more of the heat exchangers 19 could also or instead be a shell heat exchange, a tube heat exchanger, a coil heat exchanger or other.

The other part of the pyrolysis gas will simultaneously travel towards the gasifier 7 through an input conduit 16 arranged to guide the pyrolysis gas from the pyrolysis gas outlet 3 to a combustion unit 17 in a heating device 15.

In the embodiment disclosed in FIG. 1 the pyrolysis gas will also pass a flow generator 27—arranged to generate or at least aid the gas flow during this travel—before it enters the heating device 15. However, in the embodiment disclosed in FIG. 2 the flow of pyrolysis gas towards the gasifier 7 is generated by the recycling means 14 and/or the pressure generated by the pyrolysis process in the pyrolysis units 2.

In the combustion unit 17 the pyrolysis gas is partially oxidized in that air, oxygen enriched air or pure oxygen is added to the pyrolysis gas through an oxidation inlet 28 so that a part of the pyrolysis gas is combusted, which in turn will raise the temperature of the resulting heating gas to around 1,150° C. (or at least typically in the 900-1300° C. range) before the heating gas leaves the heating device 15 through an output conduit 18 arranged to guide the heating gas to a gasifier inlet 10 of the gasifier 7. Heating the gas to this relative high temperature level ensures a more efficient tar decomposition.

However, heating gas that is this hot might damage the gasifier 7 and particularly the grate device 25 on which the pyrolyzed coke 13 rests in the gasifier 7 and in this embodiment the heating gas is therefore cooled to around 900-1,000° C. (preferably around 950° C.) before it enters the gasifier 7. In this embodiment, the heating gas is cooled by means of cooling means 21 including means for blowing steam into the heating gas through a cooling inlet 29. However, in another embodiment the cooling means 21 could also or instead be enabled otherwise—such as by blowing $CO_2$, $H_2$, $CH_4$, biogas or other into the heating gas or by means of cooling tubes, a cooling shawl, a heat exchanger or other.

The cooled heating gas now enters the gasifier through the gasifier inlet 10 at the bottom 11 of the gasifier 7 from where it will flow upwards and thereby gasify the pyrolyzed coke to form a gas mixture named product gas which leaves the gasifier through the product gas outlet 8 arranged at the top 9 of the gasifier 7.

In this embodiment, some of the produced product is returned by means of a return conduit 30 so that it re-enters the gasifier 7 through the gasifier inlet 10 to help cooling the heating gas before it enters the gasifier 7.

It should be noted that the term "partial oxidation" in this embodiment means that some oxygen is added to the pyrolysis gas but not enough to fully combust the pyrolysis gas completely. I.e. in this specific embodiment enough oxygen is added that all the pyrolysis gas is approximately 35% combusted (which is a more correct way to put it than saying that 35% of the pyrolysis gas is combusted). However, in another embodiment the partial oxidation involves adding enough oxygen to combust all the pyrolysis gas between 10% and 60%, preferably between 25% and 50%. Furthermore, it should be noted that the oxygen may be added in the form of pure liquid or gaseous oxygen, an oxygen containing compound—such as air, methanol or other, a mixture of oxygen and water vapor, a mixture of oxygen and $CO_2$ and/or in another form and/or mixed with another gas or vapor.

The invention has been exemplified above with reference to specific examples of pyrolysis units 2, gasifiers 7, coke moving means 12 and other. However, it should be understood that the invention is not limited to the particular examples described above but may be designed and altered in a multitude of varieties within the scope of the invention as specified in the claims.

LIST

1. Gasification unit
2. Counterflow pyrolysis unit
3. Pyrolysis gas outlet
4. Upper part of pyrolysis unit
5. Pyrolysis gas inlet
6. Lower part of pyrolysis unit
7. Gasifier
8. Product gas outlet
9. Upper part of gasifier
10. Gasifier inlet
11. Lower part of gasifier
12. Coke moving means
13. Pyrolyzed coke
14. Recycling means
15. Heating device
16. Input conduit
17. Combustion unit
18. Output conduit
19. Heat exchange means
20. Filtering means
21. Cooling means
22. Screw conveyor
23. Fuel
24. Fuel inlet
25. Grate device
26. Ash outlet
27. Flow generator
28. Oxidation inlet
29. Cooling inlet
30. Return conduit

The invention claimed is:

1. A gasification unit for producing a product gas, said gasification unit comprising, a co-current or counterflow pyrolysis unit comprising a pyrolysis gas outlet arranged at an upper part of said pyrolysis unit and a pyrolysis gas inlet arranged at a lower part of said pyrolysis unit, a co-current or counterflow gasifier comprising a product gas outlet arranged at an upper part of said gasifier and a gasifier inlet arranged at a lower part of said gasifier, a coke mover for allowing pyrolyzed coke to move from said pyrolysis unit to said gasifier, a recycler arranged to guide at least a part of the pyrolysis gas produced in said pyrolysis unit from said pyrolysis gas outlet and back to said pyrolysis gas inlet as recycled pyrolysis gas, and a heating device comprising an input conduit arranged to guide pyrolysis gas from said pyrolysis gas outlet to a combustion unit in said heating device, wherein said combustion unit is arranged to at least partially oxidize said pyrolysis gas from said pyrolysis unit, and wherein said heating device comprises an output conduit arranged to guide heating gas generated by said partial oxidization in said combustion unit to said gasifier inlet, wherein said heating device is arranged external to said pyrolysis unit and said gasifier and wherein said gasification unit further comprises a heat exchanger arranged for heating at least a portion of said recycled pyrolysis gas passing through said recycler before it reenters said pyrolysis unit through said pyrolysis gas inlet by at least a part of the product gas exiting said gasifier through said product gas outlet and wherein said recycler is arranged to guide said recycled pyrolysis gas from said pyrolysis gas outlet and back to said pyrolysis gas inlet without said recycled pyrolysis gas passing through said combustion unit in said heating device.

2. A gasification unit according to claim 1, wherein said pyrolysis gas is heated by said product gas in the heat exchanger.

3. A gasification unit according to claim 1, wherein said pyrolysis gas is heated in a first heat exchanger and said product gas delivers heat in a second heat exchanger and wherein a separate fluid flow ensures heat transfer between said first and said second heat exchangers.

4. A gasification unit claim 1, wherein said heat exchanger comprises at least one plate heat exchanger.

5. A gasification unit claim 1, wherein said gasification unit comprises a cooler for cooling said heating gas to a temperature between 600° C. and 1,200° C., preferably between 700° C. and 1,100° C. and most preferred between 800° C. and 1,000° C. before it enters said gasifier.

6. A gasification unit according to claim 5, wherein said cooler adds steam to said heating gas and/or adds product gas to said heating gas to cool said heating gas.

7. A gasification unit claim 1, wherein said co-current or counterflow pyrolysis unit is arranged on top of said co-current or counterflow gasifier.

8. A gasification unit claim 1, wherein said coke mover comprises a screw conveyor.

9. A method for producing a product gas in a gasification unit, said method comprising the steps of:

feeding fuel to a co-current or counterflow pyrolysis unit, circulating at least a part of the pyrolysis gas produced by said fuel in said pyrolysis unit directly back into said pyrolysis unit as recycled pyrolysis gas to form a flow of recycled pyrolysis gas up through said fuel, heating at a heating device said pyrolysis gas before it re-enters said pyrolysis unit, pyrolyzing said fuel by said re-entering heated pyrolysis gas, enabling that said pyrolyzed fuel in said pyrolysis unit is moved to a gasifier, combusting at a combustion unit in the heating device, at least a part of said pyrolysis gas outside said pyrolysis unit and said gasifier to form heating gas, and guiding said heating gas into said gasifier to heat said pyrolyzed fuel to produce a product gas, wherein said recycled pyrolysis gas is heated by said product gas before said pyrolysis gas re-enters said pyrolysis unit;

wherein said recycled pyrolysis gas is guided from said pyrolysis gas outlet and back to a pyrolysis gas inlet without said recycled pyrolysis gas passing through the combustion unit in the heating device.

10. A method according to claim 9, wherein said pyrolysis gas is heated by said product gas by guiding said pyrolysis gas and said product gas through the heat exchanger.

11. A method according to claim 9, wherein said pyrolysis gas is heated by said product gas by guiding said pyrolysis gas through a first heat exchanger and guiding said product gas through second heat exchanger and establish a separate fluid flow between said first and said second heat exchangers to transfer heat between said first and said second heat exchangers.

12. A method according to claim 9, wherein between 1% and 95%, preferably between 5% and 70% and most preferred between 10% and 50% of the pyrolysis gas produced by said fuel in said pyrolysis unit is circulated back into said pyrolysis unit to form a flow of pyrolysis gas up through said fuel.

13. Use of a method according to claim 9 for producing a product gas from biomass in a gasification unit.

* * * * *